US005829864A

United States Patent [19]

Scanlan

[11] Patent Number: 5,829,864

[45] Date of Patent: Nov. 3, 1998

[54] LIGHT STRIP WITH DECORATIVE TRIM

[76] Inventor: Daniel J. Scanlan, 3708 Wilke Rd., Rolling Meadows, Ill. 60008

[21] Appl. No.: 22,394

[22] Filed: Feb. 12, 1998

[51] Int. Cl.[6] ..... F21V 33/00

[52] U.S. Cl. ..... 362/133; 362/127; 362/249; 312/223.5

[58] Field of Search ..... 362/125, 127, 362/133, 249, 147; 312/223.5, 223.6, 223.1

[56] References Cited

U.S. PATENT DOCUMENTS

| | | | |
|---|---|---|---|
| D. 359,374 | 6/1995 | Weinstock . | |
| D. 384,762 | 10/1997 | Roorda . | |
| D. 384,763 | 10/1997 | Roorda . | |
| 4,154,492 | 5/1979 | Dunning, III | 362/133 |
| 4,254,449 | 3/1981 | Benasutti et al. | 362/33 |
| 4,622,624 | 11/1986 | McCarthy et al. . | |
| 4,918,579 | 4/1990 | Bennett | 362/126 |
| 5,426,572 | 6/1995 | Weinstock et al. . | |
| 5,437,504 | 8/1995 | Halvatzis . | |
| 5,559,393 | 9/1996 | Nilssen . | |

*Primary Examiner*—Thomas M. Sember
*Attorney, Agent, or Firm*—Knechtel, Demeur & Samlan

[57] ABSTRACT

A light fixture with decorative trim for mounting under a cabinet which is both functional in providing light onto a work surface and also is attractive in its appearance. The fixture has a front decorative strip and a rear decorative strip mounted to a base panel. The base panel has lights mounted in it. The front decorative strip is an attractive trim strip that faces the user. Alternatively the rear decorative trim strip on the opposite side of the base panel can be oriented to face the user thereby giving the user either of two alternatives in selecting the desired decorative trim. There are side strips that also have an identical decorative surface facing the user whereby the entire fixture extends around the bottom of the cabinet. The fixture also provides a wireway within itself to enclose wires which provide power to the lights.

10 Claims, 3 Drawing Sheets

LIGHT STRIP WITH DECORATIVE TRIM

FIELD OF THE INVENTION

This invention relates to a light fixture which is designed to be mounted under a cabinet and has a decorative front facing edge which extends around the entire bottom of the cabinet and is presented to the observer.

BACKGROUND OF THE INVENTION

In the office or home environments it is often desirable to install lights under cabinets to provide sufficient lighting to a work surface which may be necessary to perform work tasks. At other times lighting is installed for design or aesthetic purposes. An under the cabinet light fixture is preferable to table or desk lamps due to space limitations and the desire to keep the work surface free from clutter.

In the past, lights have been installed in the bottom of the cabinet with the lights directed to the work surface. A problem with this installation is that the lights and their associated wiring protrude into the bottom of the cabinet and interfere with glasses, dishes or other items stored in the cabinet. Also, the lights can get very hot and the possibility exists that the user can be burned if he or she touches the light when reaching for an item in the cabinet.

Another problem with prior lighting fixtures designed to be installed under a cabinet is that they were not attractively designed. Oftentimes the fixtures were industrial looking, did not blend well with the cabinet or were of a different design or color than the cabinet. At other times the power cables or wires were exposed, which presented an unattractive appearance.

Various designs have been proposed for light fixtures that are adaptable for mounting under a cabinet. For example U.S. Pat. No. Des. 359,374 entitled Light Fixture illustrates several embodiments for a light fixture that may contain one, two or three lights. Other patents which illustrate designs for lighting fixtures for mounting under a cabinet are U.S. Pat. No. Des. 384,762 entitled Twin Lamp Low Profile Under Cabinet Light Bar and U.S. Pat. No. Des. 384,763 entitled Triple Lamp Low Profile Under Cabinet Light Bar.

U.S. Pat. No. 5,437,504 entitled Display Lighting Fixture and Method of Using Same illustrates a display case lighting fixture which is capable of being installed within display cases of varying widths. It provides an adjustment mechanism that expands or contracts from the ends of the fixture to hold the fixture between the side walls of the display case. It does not mount to the underside of the cabinet but rather to the side walls of the display case.

U.S. Pat. No. 5,559,393 entitled Under-The-Cabinet Lighting System discloses the use of a power supply which provides a high frequency current to energize a special florescent current lamp. U.S. Pat. No. 4,622,624 entitled Under Shelf Task Lighting System illustrates a florescent light fixture which uses a perforated panel to control the amount and direction of light emitted by the lamp.

U.S. Pat. No. 5,426,572 entitled Light Fixture illustrates a low profile light fixture that uses halogen lamps to achieve the low profile. There is a mounting plate which is mounted to the underside of the cabinet or other horizontal surface. An enclosure is mounted to the backing plate and has the lamps mounted in it.

A problem with all of the above patents is that they are not modifiable to provide varying numbers of lights depending on the length of the cabinet. Another shortcoming of all of the above patents is that they do not provide an attractive, decorative appearance towards the front or sides of the cabinet. Furthermore none of the above patents illustrate a fixture which can provide lights in side strips which mount under the cabinet thereby providing light not only across the front of the cabinet, but along the sides as well. Also, none of the prior devices provide a completely enclosed wireway for the power cords.

Thus it is a object of the invention to provide a fixture which can be mounted under a cabinet which can be cut to the exact length of the front of the cabinet. A related object is to provide a light fixture that has a decorative trim which presents a pleasing appearance to the observer and hides the lamps behind the trim.

Another object is to provide a lamp fixture that provides a decorative trim along the sides of the cabinet. Still another related object is to provide lamps in the side portions of the fixture to provide lamps along the sides of the cabinet.

Another object is to provide a light fixture that provides hidden wireways within the fixture to hide the wires that provide power to the individual lamps.

These and other objects and advantages will be apparent upon a review of the drawings and reading the detailed description of the preferred embodiment.

DESCRIPTION OF THE PREFERRED EMBODIMENT

Figure 1:
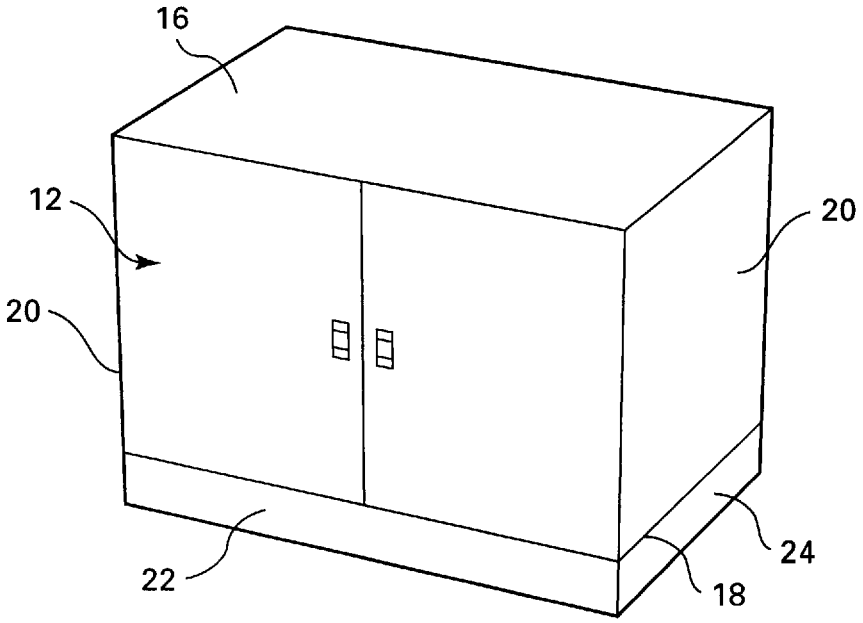
FIG. 1 is right front perspective view of a cabinet with the inventive light fixture and decorative trim mounted to it.
Figure 2:
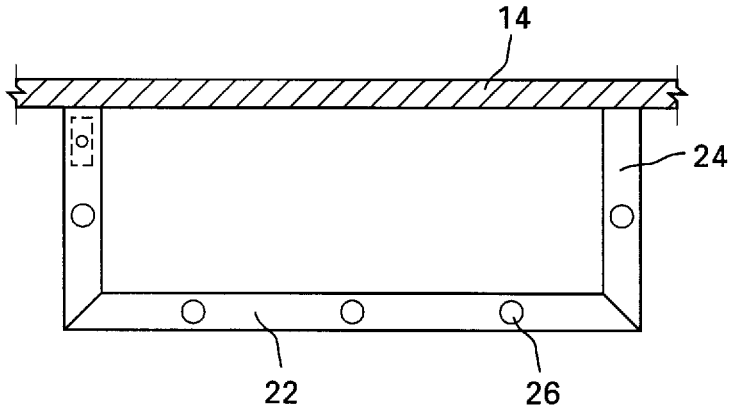
FIG. 2 is a bottom view of the inventive light fixture mounted to the underside of the cabinet.
Figure 3:
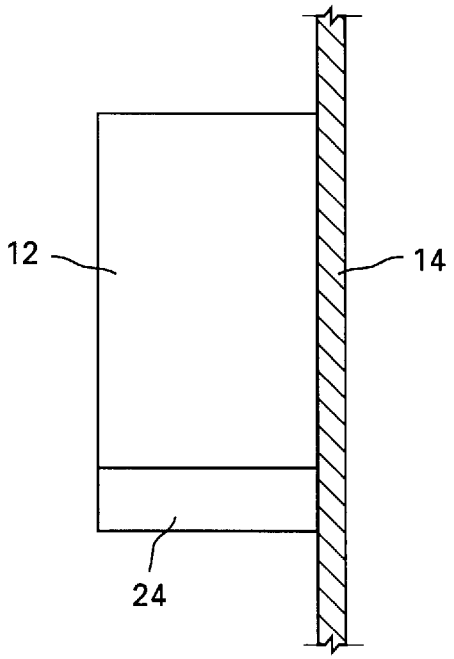
FIG. 3 is a side view of the light fixture mounted to the underside of a cabinet with the cabinet mounted to a wall.

Turning first to FIGS. 1 through 3 there is illustrated a light fixture with decorative trim 10 of the present invention. The fixture 10 is mounted to a cabinet 12 which is mounted to a wall 14. The cabinet 12 is of conventional design, having a top 16, a bottom 18, and opposite sides 20. The fixture 10 has a front light strip 22 mounted to the bottom 18, and a pair of side strips 24 mounted to opposite sides of the cabinet 12. There are lights 26 mounted on the front light strip 22 with the light directed downward onto a surface below. Although not required, the lights 26 may also be mounted in the side strips 24 if desired. The lights are preferably halogen lamps that operate on 12 volts which is ideal for safety. These are very low profile lights that take up a minimum amount of height.

Figure 4:
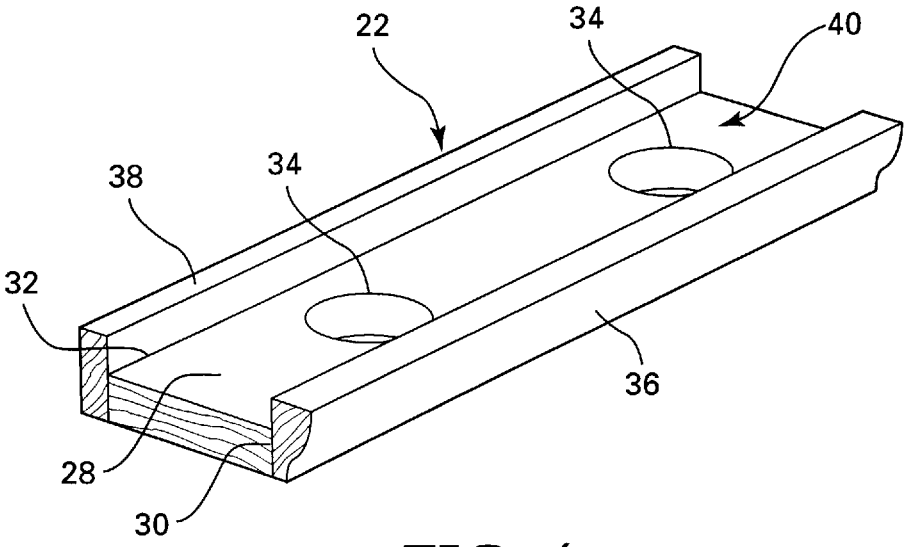
FIG. 4 is a perspective view of a front decorative light strip with two decorative trim strips mounted to opposite sides of the light strip.

The light strip 22 is more clearly illustrated in FIG. 4. The strip 22 has a first bottom panel 28 which has a front facing edge 30 and a rear facing edge 32. The front facing edge is the edge which faces the front of the cabinet and the user. The bottom panel 28 has a series of holes 34 cut into the bottom to receive the lights 26. Mounted to the front edge 30 is a first front decorative trim 36. The trim 36 covers the front edge 30 and extends upward above the bottom panel 28 approximately ⅜ inches. The decorative trim 36 can be of any one of numerous designs such as a bull nose, ogee, or square edge. Scalloped or other geometric shapes can also be used. The trim 36 extends across the entire length of the bottom panel 28.

There is a first rear decorative trim 38 mounted to the rear edge 32. The trim 38 also extends across the entire length of the bottom panel 28. It can be of any one of a number of designs such as the first rim 36. However it should be of a different design than the first trim 36. Thus the user of the light fixture is given two alternatives for selecting the decorative trim by merely turning the light strip 22 180 degrees to present the alternative side of the strip 22 and alternate trim to the user/observer.

Figure 5:
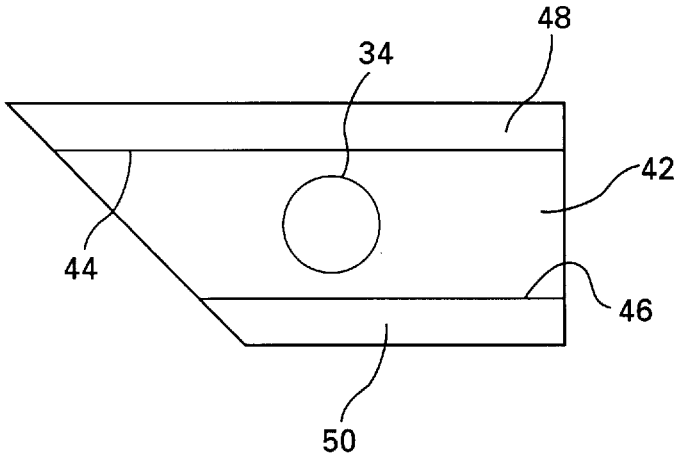
FIG. 5 is a top view of a side decorative trim strip with one end cut at a 45° angle.

The side strip 24 is similar to the front light strip 22 in construction. As seen in FIG. 5, there is a second bottom panel 42 which may or may not have holes 34 cut in it. If the user desires to have additional lights along the sides of the cabinet 12, there will be provided the holes 34 and lights 26 mounted therein. The second bottom panel 42 has a second front facing edge 44 and a second rear facing edge 46. A second front decorative trim 48 is attached to the second front facing edge 44 and a second rear decorative trim 50 is attached to the second rear facing edge 46.

The designs of the second front and rear decorative trims are respectively the same as the first front 36 and first rear 38 decorative trims. Thus when the front light strip 22 and side strip 24 are mounted under the cabinet 12, they present the same design to the user. The second front trim 48 and second rear trim 50 both extend above the bottom panel 42 approximately ⅜ inches which forms a wireway 52. When the front strip 22 and side strip 24 are mounted under the cabinet 12, the wire channel 40 and wireway 52 are in communication with each other. This allows the electrical wires leading to the lights 26 to be completely enclosed within the wire channel 40 and wireway 52. Thus, the user does not see the wires from the power source, which results in a neat and clean appearance. It also provides a safety feature as no wires are exposed.

Figure 6:
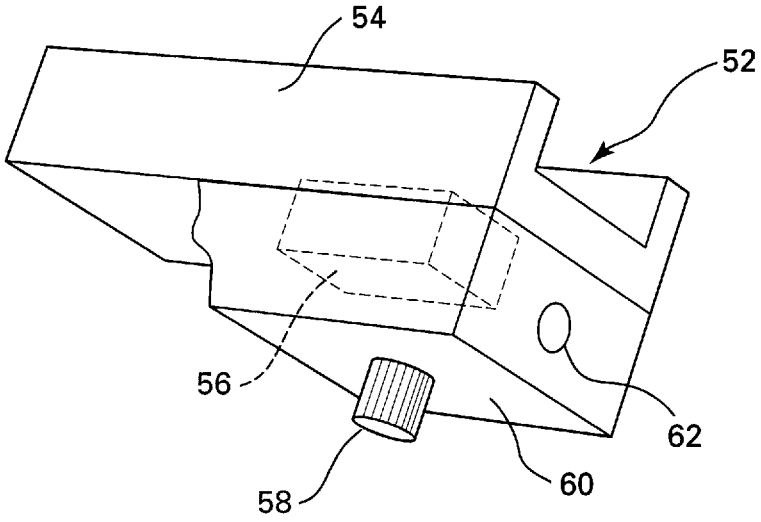
FIG. 6 is a perspective view of a side decorative trim strip with a power supply and dimmer switch therein.

FIG. 6 illustrates a construction of an alternate side strip 54. In this strip there is a transformer 56 which provides low voltage power to the lights 26. There is also an on/off dimmer switch 58 mounted in a metal box 60 which controls energization of the lights 26 and the light intensity. A knock out 62 is provided at one end of the box 60 to allow conduit to enter the box 60.

Another side strip identical to strip 24 can be provided to provide a complete fixture that extends around the entire bottom of the cabinet. It is seen in FIG. 2 that the light strip 22 and side strips 24 are cut at 45 degree angles where they meet each other so that the front facing edges extend across the entire face of the strip. This presents a more pleasing surface to the observer than if 90 degree ends are used. The strips 22 and 24 are supplied to the user in standard four foot or eight foot lengths which are then cut to exact size at the location of the cabinets. Thus a custom length is cut to accommodate variations in the length and width of the cabinet 12. The lights 26 can be factory installed and mounted into the holes 34. However, if a short strip is needed, it may result in throwing away some lights if the actual length used is less than the number of lights is a strip. Thus, it may be preferable to supply the strips without the lights and install the lights as needed at the job location.

Thus there has been provided a light strip with decorative trim that fully satisfies the objects and advantages as set forth above. It is evident that many alternatives, modifications and variations will be apparent to those skilled in the art. Accordingly, it is intended to embrace such variations as fall within the spirit and broad scope of the intended claims.

I claim:

1. A combination light fixture and decorative trim for mounting under a wall mounted cabinet, wherein the cabinet has a front, opposite sides, and a rear, the rear of the cabinet mounted to the wall, the combination fixture and trim comprising:

a light strip adapted for mounting under the front of the cabinet and comprising:

a first bottom panel having front and rear edges and a plurality of light receiving holes, a first front decorative trim strip at the front edge of the first bottom panel with a part of the first front decorative trim strip extending above a top of the first bottom panel, a length of the first decorative trim strip being substantially the same as a length of the front of the cabinet, a first rear trim strip at the rear edge of the first bottom panel with a part of the first rear trim strip extending above the top of the first bottom panel, a wireway defined by the first bottom panel, first front decorative trim strip, and first rear trim strip, the wireway being enclosed on four sides when the light strip is mounted to the underside of the cabinet, and means to provide electrical power to the lights.

2. The combination light fixture and decorative trim of claim 1 and further comprising:

at least one side strip adapted for mounting under one side of the cabinet, the side strip comprising:

a second bottom panel having front and rear edges, a second front decorative trim strip at the front edge of the second bottom panel with a part of the second front decorative trim strip extending above a top of the second bottom panel, a length of the second trim strip being substantially the same as a width of the side of the cabinet, a second rear trim strip at the rear edge of the second bottom panel with a part of the second rear trim strip extending above the top of the second bottom panel, a second wireway defined by the second bottom panel, second front decorative trim strip, and second rear trim strip, the second wireway being enclosed on four sides when the side strip is mounted to the underside of the cabinet, the first and second wireways being in communication with each other when the light strip and side strip are mounted under the cabinet.

3. The combination light fixture and decorative trim of claim 2 wherein the first and second front decorative trim strips are identical in design.

4. The combination light fixture and decorative trim of claim 2 wherein the first and second rear trim strips are decorative trim strips with a different design than the first and second front decorative trim strips and wherein the light strip and side strip can be rotated 180 degrees for mounting under the cabinet and the rear trim strips become the front decorative trim strips when so mounted.

5. The combination light fixture and decorative trim of claim 2 and further comprising a second side strip comprising:

a third bottom panel having front and rear edges, a third front decorative trim strip at the front edge of the third bottom panel with a part of the third front decorative trim strip extending above a top of the third bottom panel, a length of the third trim strip being substantially the same as the width of the side of the cabinet, a third rear trim strip at the rear edge of the third bottom panel with a part of the third rear trim strip extending above the top of the third bottom panel, a third wireway defined by the third bottom panel, third front decorative trim strip, and third rear trim strip, the third wireway being enclosed on four sides when the second side strip is mounted to the underside of the cabinet, the first and third wireways being in communication with each other when the light strip and second side strip are mounted under the cabinet.

6. The combination light fixture and decorative trim of claim 5 wherein the first and third rear trim strips are decorative trim strips with a different design than the first and third front decorative trim strips and wherein the second side strip can be rotated 180 degrees for mounting under the cabinet and the rear trim strips become the front decorative trim strips when so reversed for mounting.

7. The combination light fixture and decorative trim of claim 2 wherein the lamps are halogen lamps.

8. The combination light fixture and decorative trim of claim 2 wherein the light strip and side strip respectively are supplied in lengths greater than the length and width of the cabinet, and are cut to the length and width of the cabinet at a location of the cabinet installation.

9. The combination light fixture and decorative trim of claim 2 and further comprising an on/off dimmer switch to control the intensity of the lamps.

10. The combination light fixture and decorative trim of claim 2 wherein the means to provide electrical power to the lights comprises electrical wires which are enclosed within the wireways.

* * * * *